US008701882B2

(12) United States Patent
Voissem

(10) Patent No.: US 8,701,882 B2
(45) **Date of Patent: *Apr. 22, 2014**

(54) ROLLED GOODS HANDLER

(75) Inventor: Ted Voissem, Appleton, WI (US)

(73) Assignee: Badger Plug Company, Greenville, WI (US)

( * ) Notice: Subject to any disclaimer, the term of this patent is extended or adjusted under 35 U.S.C. 154(b) by 22 days.

This patent is subject to a terminal disclaimer.

(21) Appl. No.: 12/726,490

(22) Filed: Mar. 18, 2010

(65) Prior Publication Data

US 2010/0224521 A1 Sep. 9, 2010

Related U.S. Application Data

(63) Continuation of application No. 11/827,713, filed on Jul. 13, 2007, now Pat. No. 7,699,167.

(51) Int. Cl.
*B65D 85/00* (2006.01)

(52) U.S. Cl.
USPC ..... 206/416; 206/391; 206/446; 403/231

(58) Field of Classification Search
USPC ..... 206/416, 391, 394, 413, 415, 446, 386, 206/598, 597, 397, 821, 509, 512, 600; 220/4.27; 108/901, 53.5, 59; 211/89–192, 85.5; 217/43 R, 43 A; 403/231, 187, 207, 219, 252, 255, 264, 403/331, 353, 354, 381
See application file for complete search history.

(56) References Cited

U.S. PATENT DOCUMENTS

| | | | | |
|---|---|---|---|---|
| 1,098,405 | A * | 6/1914 | Reinecke | 52/656.9 |
| 3,023,890 | A * | 3/1962 | Scholten | 217/43 R |
| 3,489,274 | A * | 1/1970 | Overton et al. | 206/391 |
| 4,140,065 | A * | 2/1979 | Chacon | 108/156 |
| 4,446,964 | A * | 5/1984 | Moran | 206/597 |
| 4,832,196 | A * | 5/1989 | Butler | 206/391 |
| 6,568,058 | B1 * | 5/2003 | Wieland et al. | 29/91.1 |
| 6,631,821 | B2 * | 10/2003 | Vourganas | 206/600 |
| 6,722,809 | B2 * | 4/2004 | Hamberger et al. | 403/329 |
| 6,899,226 | B2 * | 5/2005 | Voissem | 206/397 |
| 7,641,414 | B1 * | 1/2010 | Joyce | 403/231 |

* cited by examiner

*Primary Examiner* — Andrew Perreault
(74) *Attorney, Agent, or Firm* — Lucas & Mercanti, LLP; Peter J. Phillips

(57) ABSTRACT

A container for goods having an axial dimension is provided, comprising a first end support having four corners and being oriented in a first plane, a second end support having four corners and being oriented in a second plane spaced axially from the first plane, at least two connecting rails having first and second ends, the first ends being removeably connected to the first end support and the second ends being removeably connected to the second end support, each rail being connected to a different corner of the first end support and a corresponding corner of the second end support, wherein at least one good may be suspended between and supported by the first end support and second end support.

25 Claims, 11 Drawing Sheets

30

30
30

26
14A
26

26
14A
16
26

26
27
27
26
16
26
16
16
14A 24
28
20
28
24

20
24

ROLLED GOODS HANDLER

CROSS-REFERENCE TO RELATED APPLICATIONS

This application is a continuation of U.S. Ser. No. 11/827,713, filed Jul. 13, 2007 now U.S. Pat. No. 7,699,167, which is incorporated herein by reference.

FIELD OF THE INVENTION

This invention relates to containers for handling goods having an axial dimension, and more particularly to containers having components which may be easily assembled and disassembled.

DESCRIPTION OF THE PRIOR ART

Goods having an axial dimension, such as paper, metal, plastic and cloth wound on axial cores, are often shipped and handled in rolls. The rolls are often provided with core plugs that extend into opposite ends of cylindrical cores around which the rolls are wound. The rolls can have extended cores, or flush cores wherein the core is flush with the rolled goods in which case core plugs are normally used. If the rolls are provided with extended cores, a core plug mayor may not be provided. In both cases, the core or core plug would engage supports, such as opposite ends of a shipping container, that suspend the rolls. The supports are incorporated in containers in which the rolls can be kept in inventory or shipped. The rolls may range in weight from less than 100 pounds to in excess of 1,000 pounds.

Various containers have been used to handle and ship such goods. One such container is disclosed in U.S. Pat. No. 6,899,226 to Voissem, assigned to the assignee herein. This patent discloses a reinforced box with roll suspension for handling one roll, or a plurality of rolls, supported by end supports. The end supports are connected by reinforcements having tabs or hooks at their ends to be received in respectively located openings in the end supports. The reinforcements extend substantially the full height of the end support and are inclined to form sides of the container. The inclination of the sides forms a triangulated container to enhance rigidity of the container. Other containers have been used to handle and ship single or multiple rolls of goods.

A first group of patents relates to vertical palletizing of rolls, and includes: U.S. Pat. Nos. 5,344,014; 5,450,961; 5,531,327; and 5,551,563.

A second group of patents relates to horizontal palletizing of rolls, and includes: U.S. Pat. Nos. 4,195,732; 4,832,196; 4,901,870; and 5,080,314.

A third group of patents relates to horizontal packaging of rolls, individually or in an array, and includes: U.S. Pat. Nos. 4,042,107; 4,058,216; 4,079,835; 4,151,914; and 6,805,239

The first group of patents relate to containers which arrange the goods so that their axial dimensions are vertical, with the weight of the goods resting on their end which may cause damage to the end of the roll.

Many of the containers of these patents do not suspend rolls of the goods vertically to protect them from being dented or flatten at a radial location.

Many of the containers use a large amount of material, resulting in waste and excess weight in shipping.

Many of the containers use material which is assembled relatively permanently to form a container. To disassemble the container, the container typically needs to be destroyed, which also results in waste.

Many of the containers are difficult to assemble.

Many of the containers are inflexible in their size, and cannot be sized up or down due to demand or needs.

The containers of these prior patents generally suffer from one or more of the above disadvantages.

SUMMARY OF THE INVENTION

It is an object of the invention to provide a container that is better adapted to handle and ship a variety of goods having an axial dimension, such as rolls of paper, metal, plastic or cloth, which is less expensive to manufacture, uses a relatively small amount of material or components, may be relatively easily assembled as well as easily disassembled for repeated use, and yet is strong and easily managed. Also, the invention provides a container which is flexible in that it can be sized up or down in capacity due to demand or needs.

The foregoing and other objects may be attained in accordance with the invention by providing a container for goods, such as one or a plurality of rolled goods, having an axial dimension. The invention provides a container for a good having an axial dimension, the container comprising: a first end support having four corners and being oriented in a first plane; a second end support having four corners and being oriented in a second plane spaced axially from the first plane; at least two connecting rails having first and second ends, the first ends being removeably connected to the first end support and the second ends being removeably connected to the second end support, each rail being connected to a different corner of the first end support and a corresponding corner of the second end support, wherein at least one good may be suspended between and supported by the first end support and second end support, with the axial dimension of the good in a horizontal plane.

The invention provides a container for goods having an axial dimension, the container comprising: a plurality of first end supports each having four corners, said first end supports being removeably connected in a stacked arrangement and oriented in a first plane; a plurality of second end supports each having four corners, said second end supports being removeably connected in a stacked arrangement and oriented in a second plane spaced axially from the first plane; wherein each of said first end supports and second end supports define a plurality of openings for supporting a corresponding plurality of rolled goods wound on a core; a plurality of connecting rails having first and second ends, the first ends being removeably connected to the first end supports and the second ends being removeably connected to the second end support, each rail being connected to a different corner of a first end support and a corresponding corner of a second end support, wherein each of the first end supports and second end supports has a notch cut-out in each of its corners for receiving the connecting rail, wherein the notch cut-out has an extension ear for restricting slide out of a connecting rail, wherein each of the connecting rails is longer than the spacing between the axial spacing between the first and second planes, wherein at least one good may be suspended between and supported by the first end support and second end support, with the axial dimension of the good in a horizontal plane.

BRIEF DESCRIPTION OF THE FIGURES OF THE DRAWING

A better understanding of objects, features and advantages of the invention can be gained from the following detailed description of some of its preferred embodiments, and from the accompany drawings.

DESCRIPTION OF THE PREFERRED EMBODIMENT

Figure 1:
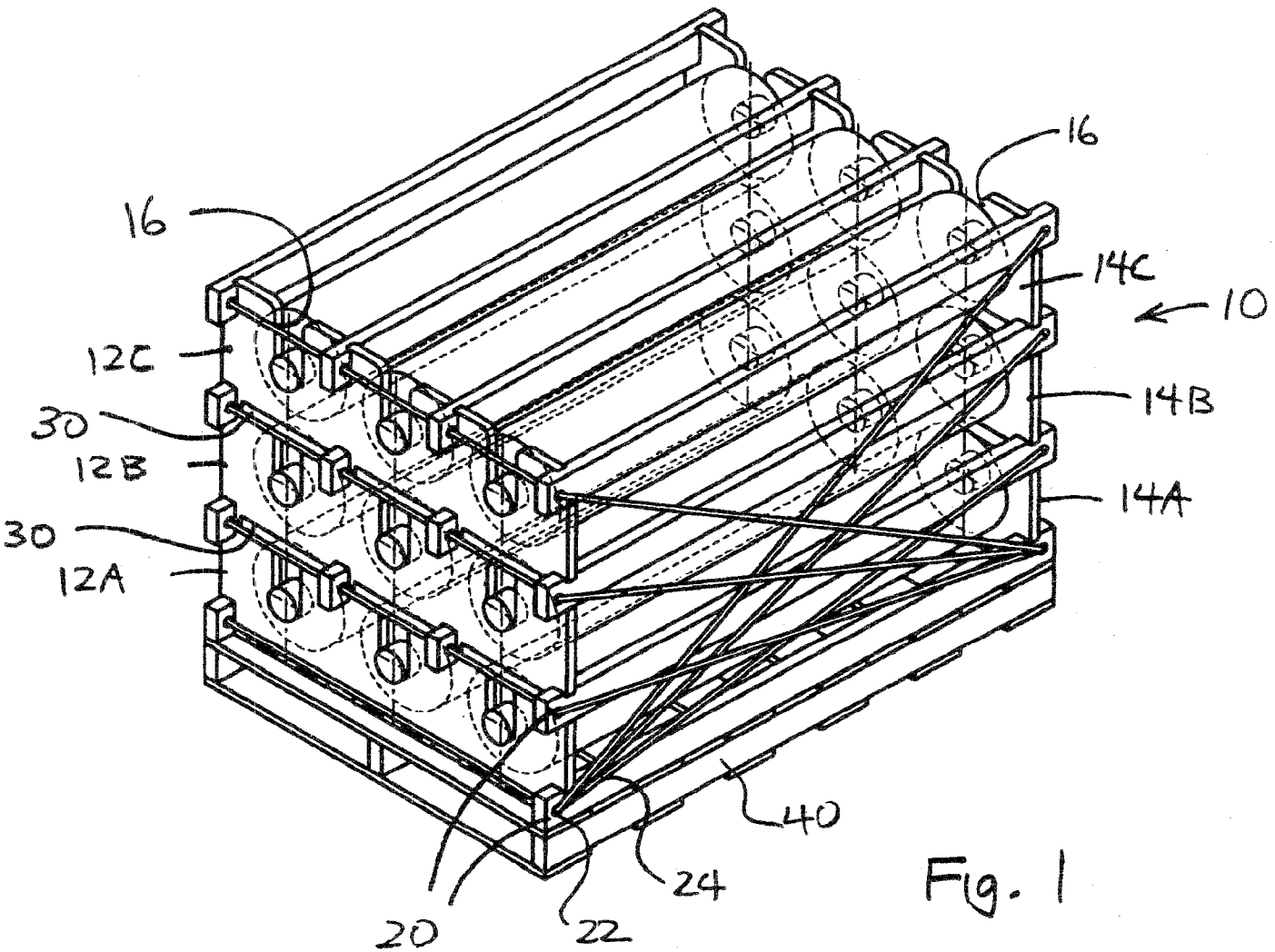
FIG. 1 is a perspective view of one embodiment of a multiple roll container in accordance with the invention.

The invention provides a container for a good having an axial dimension, the container comprising: a first end support having four corners and being oriented in a first plane; a second end support having four corners and being oriented in a second plane spaced axially from the first plane; at least two connecting rails having first and second ends, the first ends being removeably connected to the first end support and the second ends being removeably connected to the second end support, each rail being connected to a different corner of the first end support and a corresponding corner of the second end support, wherein at least one good may be suspended between and supported by the first end support and second end support, with the axial dimension of the good in a horizontal plane.

At least four connecting rails may be provided. The first end support and second end support may each define at least one opening for supporting a rolled good wound on a core. The defined opening may be a hole. The defined opening may be a U-shaped cut-out. The first end support and second end support may each define a plurality of openings for supporting a corresponding plurality a corresponding plurality of goods. Each of the first end support and second end support may have a notch cut-out in each of its corners for receiving the connecting rails. The notch cut-out may have an extension ear for restricting slide out of a connecting rail. Each of the connecting rails may be longer than the spacing between the axial spacing between the first and second planes so that the first and second ends of the connecting rails extend beyond the first and second end supports. The ends of the connecting rails may define holes for receiving a strapping material to hold the rails in position at the corners of the first and second end supports. The first and second end supports may be dimensioned relative to a good to support a plurality of goods in an axially parallel relationship. The first and second end supports each define notches along the top edges to receive connecting rails. The first and second end supports may each define notches along the bottom edges to receive connecting rails in addition to the rails at the corners. A plurality of first end supports may be arranged vertically, and a corresponding plurality of second end supports may be arranged vertically, to support at least a corresponding plurality of goods in a vertically stacked relationship. The container may further include reinforcement channel members to connect the end supports vertically. The reinforcement channel members may have an H-shaped cross-section. The container may further 10 include a member between each lowest end support and a pallet, said member being one of a U-clip member and a wood member. The container may further comprise goods, wherein the goods comprise at least one roll coiled about an axis. The ends of the rails may be removeably connected to the end supports by way of dados formed in the end of the rails which receive edges of the end supports.

The invention provides a container for goods having an axial dimension, the container comprising: a plurality of first end supports each having four corners, said first end supports being removeably connected in a stacked arrangement and oriented in a first plane; a plurality of second end supports each having four corners, said second end supports being removeably connected in a stacked arrangement and oriented in a second plane spaced axially from the first plane; wherein each of said first end supports and second end supports define a plurality of openings for supporting a corresponding plurality of rolled goods wound on a core; a plurality of connecting rails having first and second ends, the first ends being removeably connected to the first end supports and the second ends being removeably connected to the second end support, each rail being connected to a different corner of a first end support and a corresponding corner of a second end support, wherein each of the first end supports and second end supports has a notch cut-out in each of its corners for receiving the connecting rail, wherein the notch cut-out has an extension ear for restricting slide out of a connecting rail, wherein each of the connecting rails is longer than the spacing between the axial spacing between the first and second planes, wherein at least one good may be suspended between and supported by the first end support and second end support, with the axial dimension of the good in a horizontal plane.

The defined openings may be holes. The defined openings may be U-shaped cut-outs. The ends of the connecting rails may define holes for receiving a strapping material to hold the rails in position at the corners of the first and second end supports. The uppermost first and second end supports may each define notches along their top edges to receive connecting rails. The lowermost first and second end supports may define notches along their bottom edges to receive connecting rails. The container may further include reinforcement channel members to connect the end supports vertically. The reinforcement channel members may have an H-shaped cross-section. The container may further include a member between each lowest end support and a pallet, said member being one of a U-clip member and a wood member. The container may further comprise goods, wherein the goods comprise at least one roll coiled about an axis. The ends of the rails may be removeably connected to the end supports by way of dados formed in the end of the rails which receive edges of the end supports.

Preferred embodiments of the present invention will be described to provide examples of how the invention may be implemented, but the invention is not limited to the preferred embodiments described.

FIG. 1 is a perspective view of one embodiment of a multiple roll container 10 in accordance with the invention. The container 10 has a plurality of (in this case three) first end supports 12A, 128 and 12C, oriented in a first plane, and a corresponding plurality of second end supports 14A, 148 and 14C oriented in a second plane.

The first and second end supports have defined openings, which may be holes or U-shaped cut-outs 16 for supporting the ends of a core on which a roll of goods is wound or a core plug in a flush core, to suspend the goods so their axes are horizontal and so the edges and sides are essentially free of contact with the bottom of the container, and any other rolls of goods.

The container 10 has reinforcement rails 20 which are removably connected at their ends of the rails to the first and second end supports. The rails are longer than the distance between the first and second planes in which the first and second ends supports are located, so that the ends of the rails extend beyond the first and second end supports. The rails may have holes 22 in their ends to receive strapping material 24 such as rope or cording to help hold the rails in place. The rails need not have holes, as the strapping material can hold the rails and other components of the container together without passing through holes if desired.

As shown in FIG. 1, each respective end support 12 (above the lower-most end support) is supported by the end support directly below it. As used herein, the term, "support" means to serve as a foundation or prop for. The connecting rails and strapping material provide a stability function for the end support.

The first and second end supports have notch cut-outs 26 in the places where the rails removeably connect to the end supports. In FIG. 1, the notch cut-outs are located at the corners of each end support, but they may be located at other locations. The notch cut-outs are also located along the top edges of the three end supports on each end (and in the bottom edges of the top two end supports) at locations in between the suspended rolls.

The end supports are stacked vertically at each end, and several reinforcement channel members 30 having an H-shaped cross section are provided to removeably connect the end supports vertically. FIG. 1 shows three such channel members 30 to connect the upper first end support 12C to the middle first end support 12B, and three such channel members 30 to connect the middle first end support 12B to the lower first end support 12A. The other, second, end supports 14A, 14B and 14C and their connecting channel members 30 are similarly arranged but not as clearly shown in FIG. 1.

The container is shown on top of a pallet 40. Between the lower end support and the pallet is a U-clip member 50, which is best shown in FIGS. 5A-D. The U-clip has a series of holes 52 in its bottom face and enable attachment of the U-clip to the pallet and to the lower end support. The material may be corrosion resistant mild steel having a wall thickness of about 0.05 inches. Instead of using a U-clip member 50, a plain piece of wood such as a 1×2 can be attached by screws or other fasteners to each lower end support and to the pallet.

Figure 2:
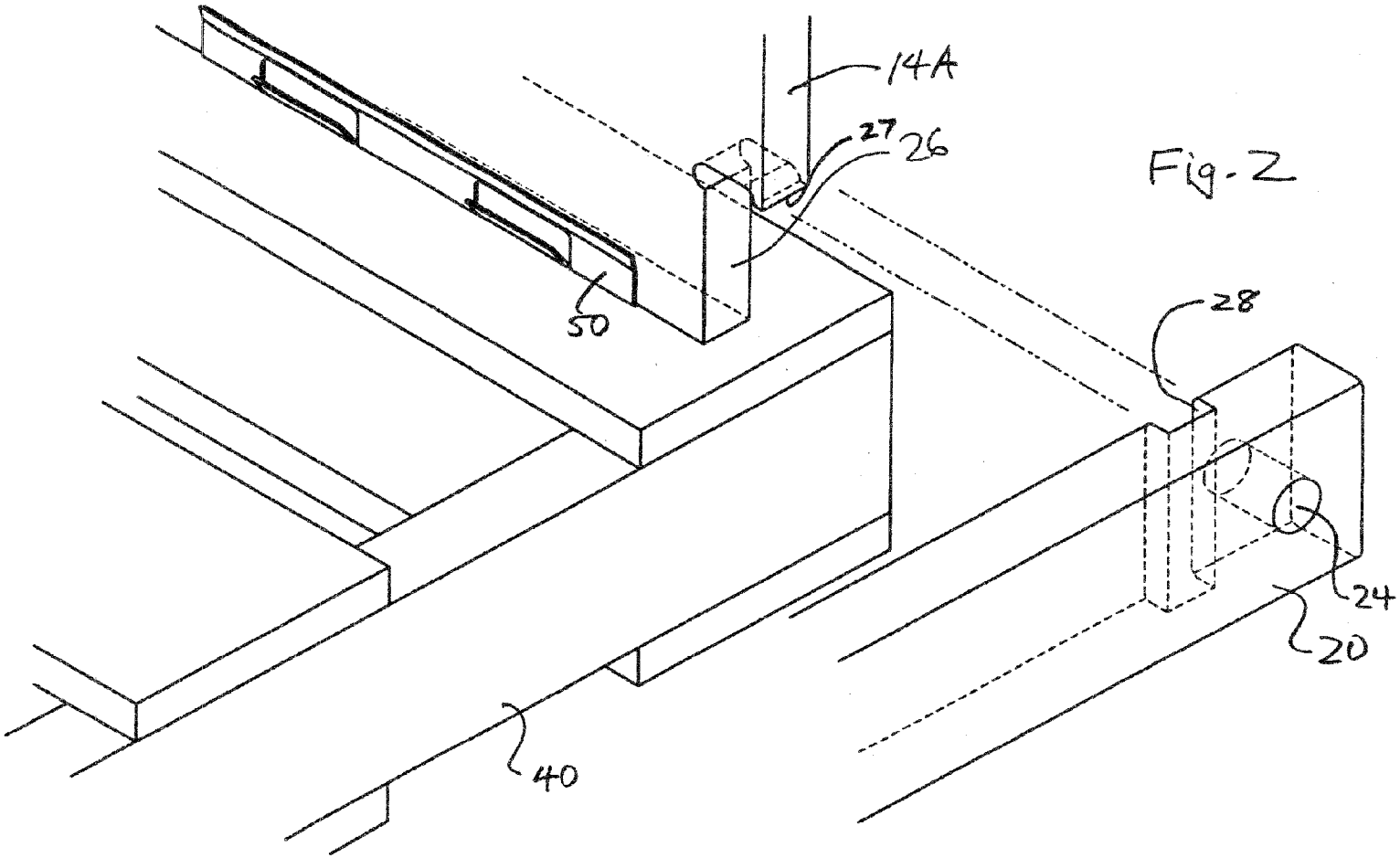
FIG. 2 is a perspective view of a lower corner detail of the embodiment of FIG. 1.

FIG. 2 shows the lower corner detail of a rail 20 and a lower end support 14A. The cut-out 26 in the lower end support 14A is about the same size as the profile of the rail. The rail 20 also has a dado 28 formed in its side to receive the end support so that the rail will not slide relative to the lower end support 14A, especially when held in place with the strapping material 24. The inside corner of the cut-out 26 is rounded and enlarged. This rounded profile may relieve stress at the corner of the end support 14A, and to also make it easier to disassemble. The outside edge of the cut-out 26 has an extension ear 27 which also aids in keeping the rail from sliding away from the end support. The ear 27 will still permit the rail to be inserted and removed from its notch 26 by angling the rail relative to the support and notch. FIG. 2 also shows the U-clip member 50 between the pallet 40 and lower end support 14A.

Figure 3:
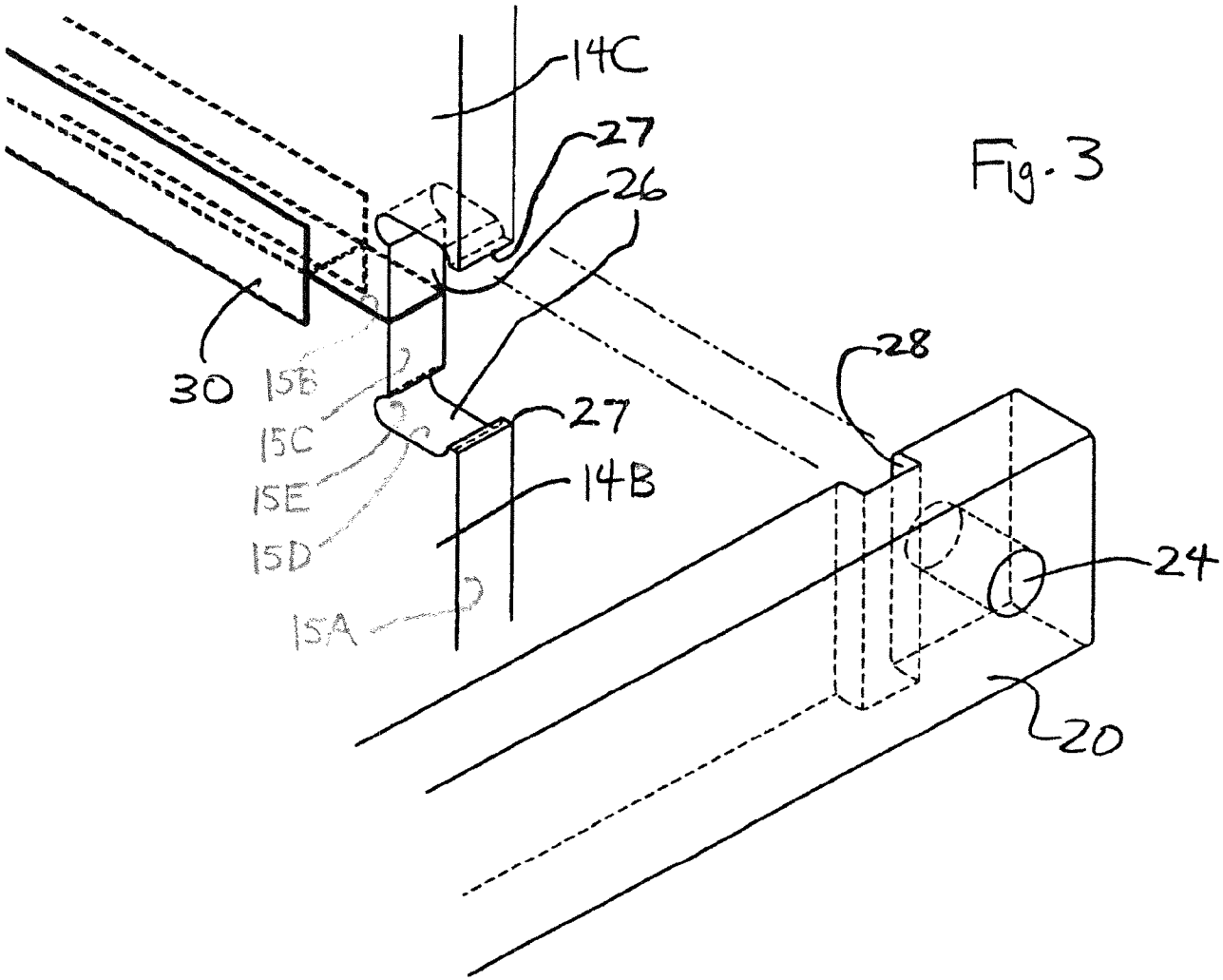
FIG. 3 is a perspective view of a middle corner detail of the embodiment of FIG. 1.

FIG. 3 shows the junction of two end supports 148 and 14C, with notches 26 and ears 27 in the corners of the end supports and an H-shaped channel member 30 holding the end supports together. The ears 27 will keep the rail from sliding out from the notches 26.

As shown in FIG. 2, the corner of the end support 14B has a vertical edge 15A and a horizontal edge 15B, and wherein each notch cut-out 26 in each corner is defined by a vertical boundary surface 15C which is inset from the vertical edge 15A, and further defined by a horizontal edge 15D which is inset from the horizontal edge 15B of the end support, and further defined by an enlarged curved cut-out portion 15E further inset from the vertical edge 15A than the vertical boundary surface 15C. The same arrangement is used for the cut-out configuration for the other corners of this end support and also for all of the corners of the other end supports. The cut-outs 26 are thus defined by above arrangement, by material removed at the corners.

Figure 4:
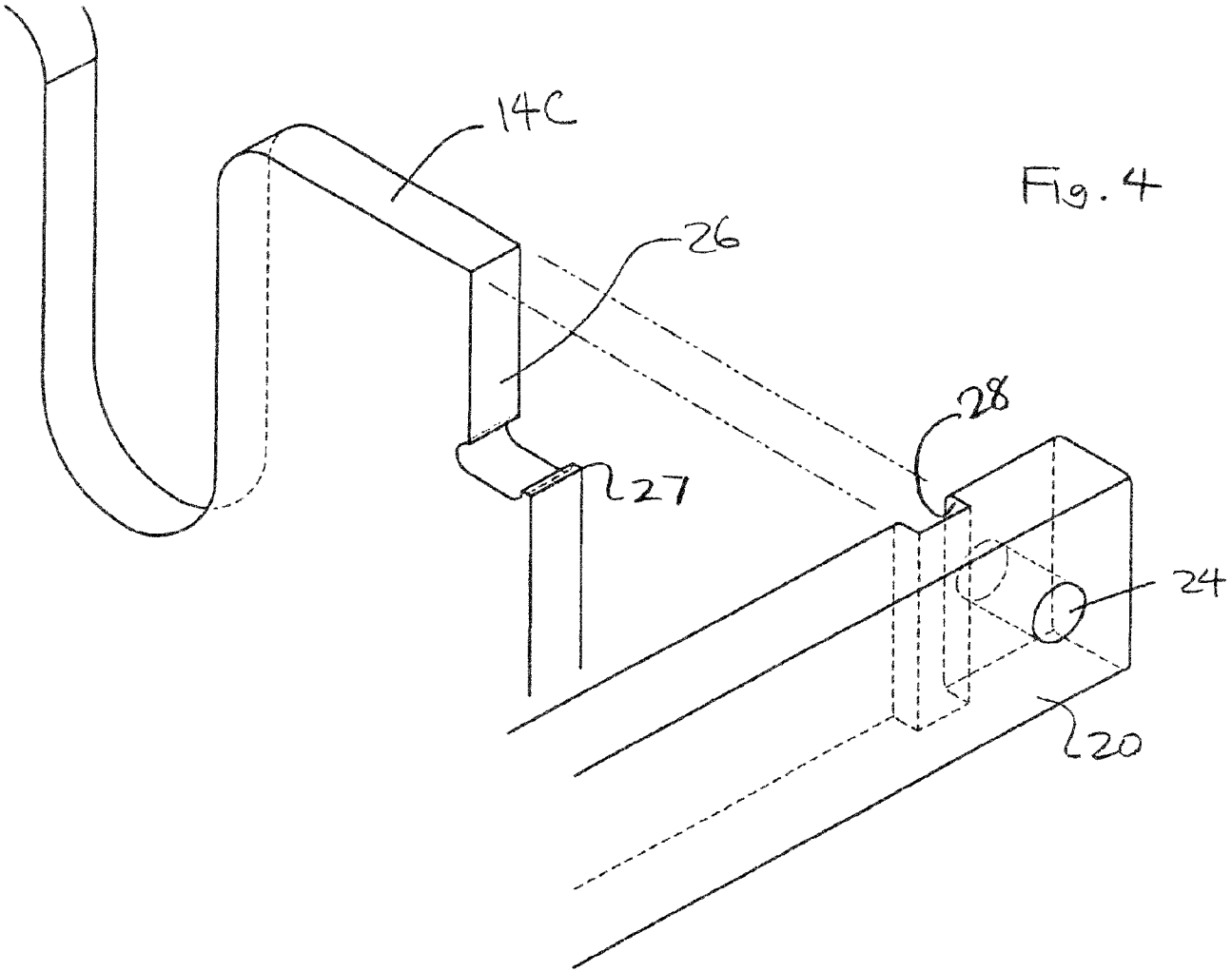
FIG. 4 is a perspective view of an upper corner detail of the embodiment of FIG. 1.
Figure 5C:
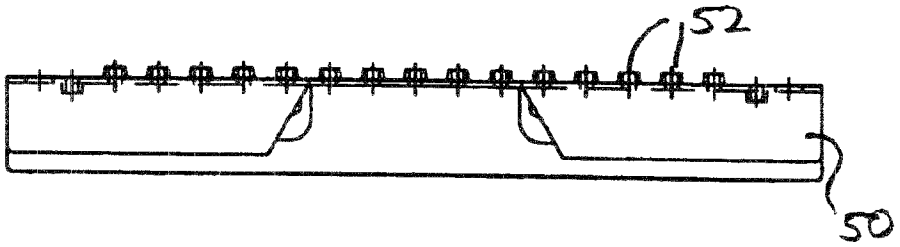
FIGS. 5A, 5B, 5C, and 5D are, respectively, side (front) elevational, top plan, side (back) elevational and end elevational views of a U-clip component of the embodiment of FIG. 1, with FIG. 5C being shown in the opposite (upside down) orientation compared to FIG. 5A FIGS. 6A, 6B and 6C are respectively, side elevational, top plan and end elevational views of an H-channel component of the embodiment of FIG. 1.
Figure 5B:
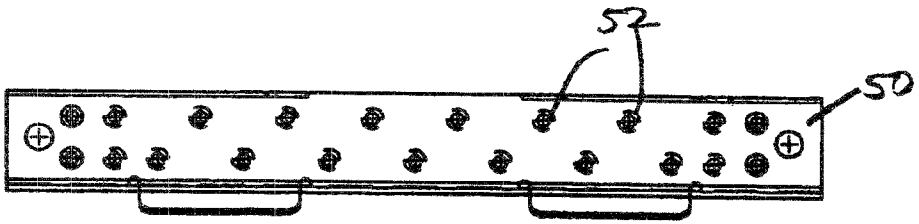
Figure 5A:
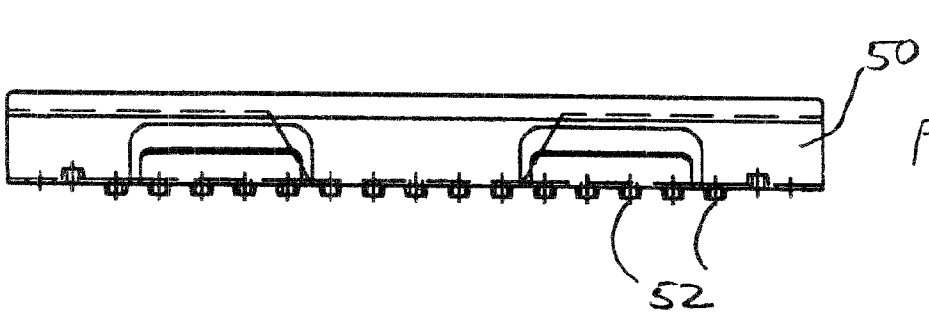
Figure 5D:
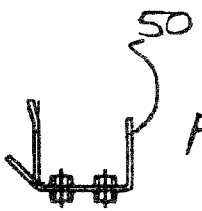

FIG. 4 shows the top corner of the top end support 14C, with the notch 26 in the top end support, an ear 27 and the dado 28 in end of the rail 20, along with the hole 24 in the rail end for the strapping material. The ear 27 will keep the rail from sliding away from the end support.

Figures 6A, 6C, 6D:
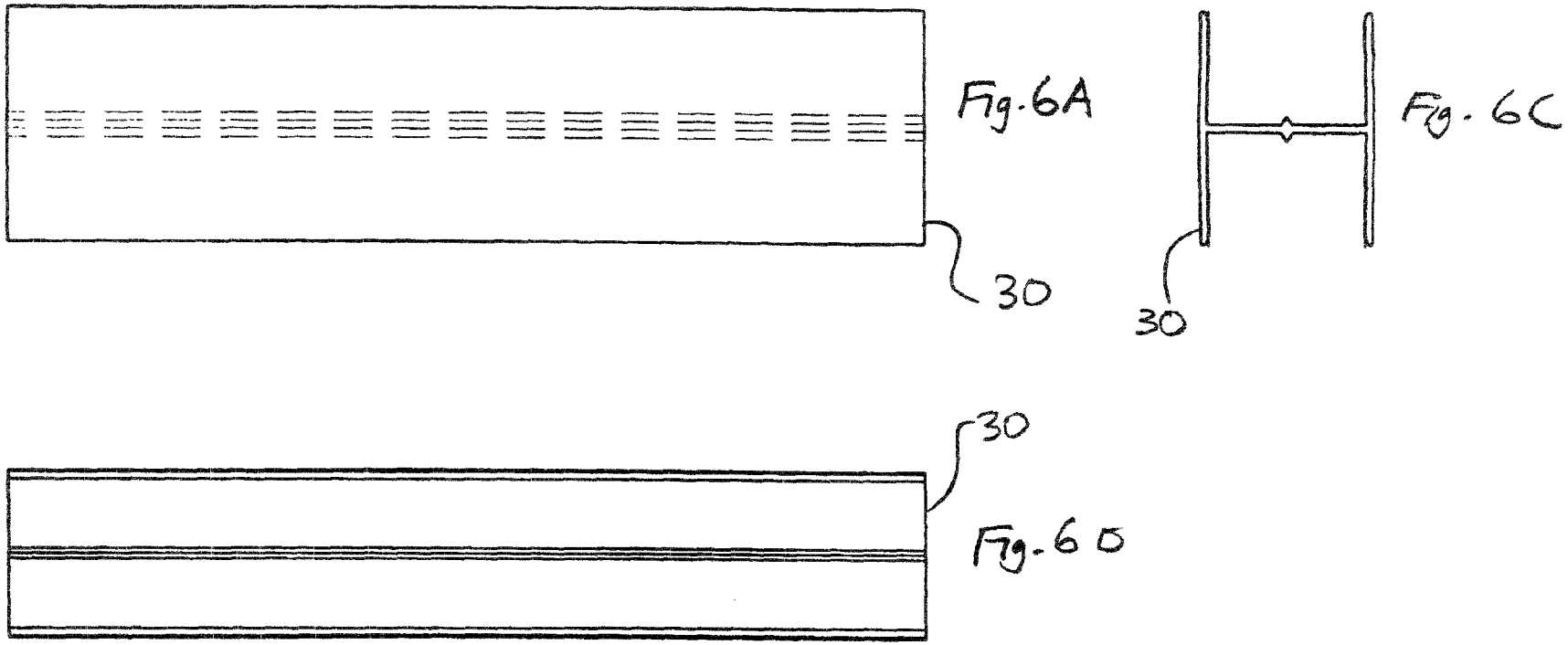

FIG. 6 shows different views of the H-channel member 30, which member may be formed of aluminum such as 6063 T5 aluminum.

Figures 7A, 7B, 7C:
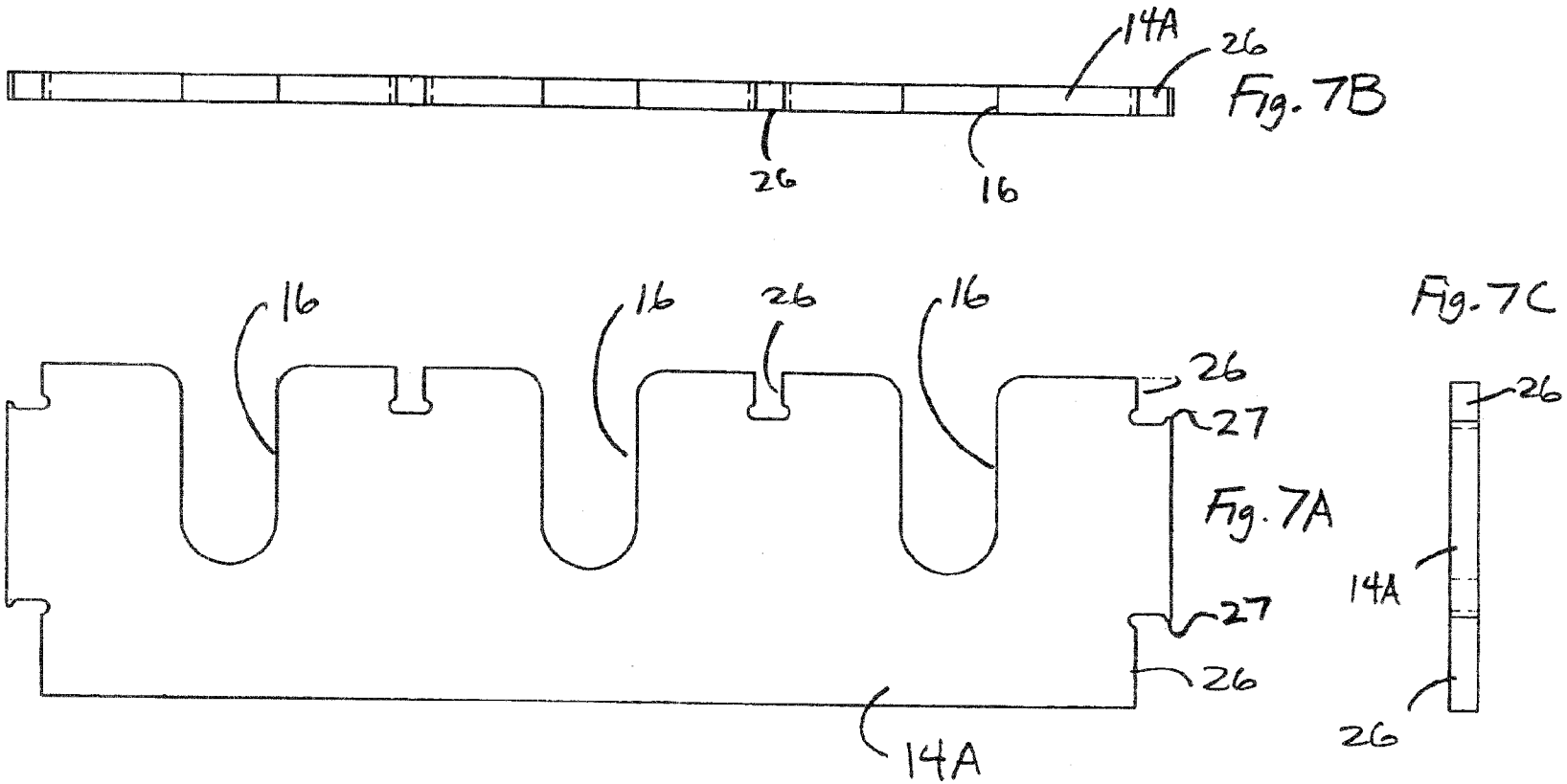
FIGS. 7A, 7B and 7C are, respectively, side elevational, top plan and edge elevational views of a U-slot bottom component of the embodiment of FIG. 1.

FIGS. 7A-7C shows the configuration of the bottom end support 12A or 14A, with its U-shaped cut-outs 16 and notches 26. Typical dimensions between the U-shaped cut outs 16 could be 13 inches for rolled goods having about 12 inches in diameter. The thickness of the end support may be about one inch, and the material of this component as well as other components may be plywood, particle board, wafer board, medium density fiber board (MDF), plastic or ferrous or non-ferrous metal.

Figure 8B:
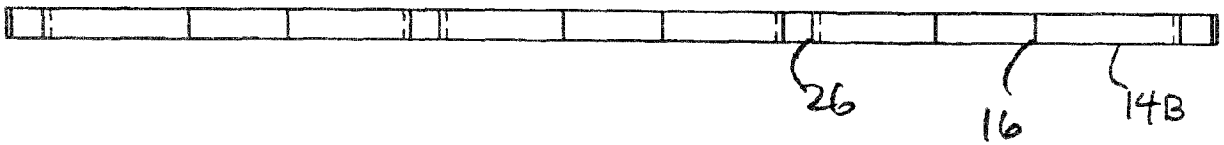
FIGS. 8A, 8B and 8C are respectively, side elevational, top plan and edge elevation view of a U-slot middle component of 15 the embodiment of FIG. 1.
Figure 8C:
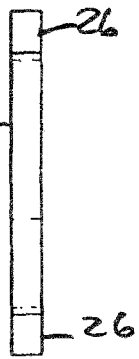
Figure 8A:
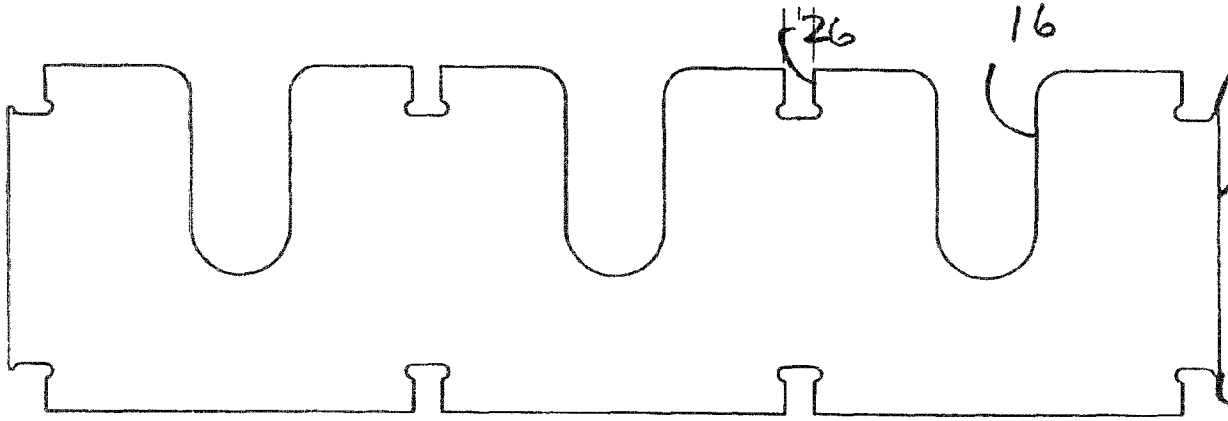
Figure 9B:
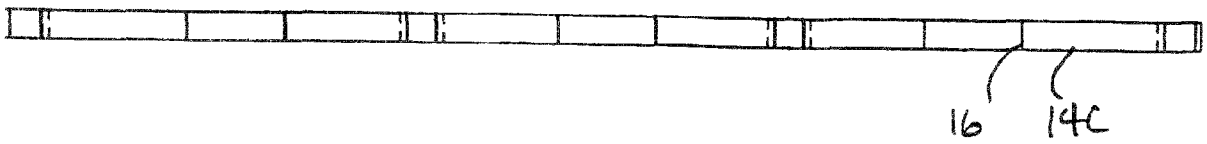
FIGS. 9A, 9B and 9C are respectively, side elevational, top plan and edge elevational views of a U-slot top component of the embodiment of FIG. 1.
Figure 9C:
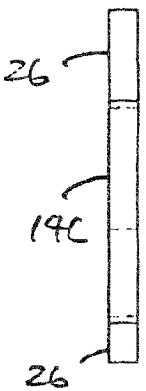
Figure 9A:
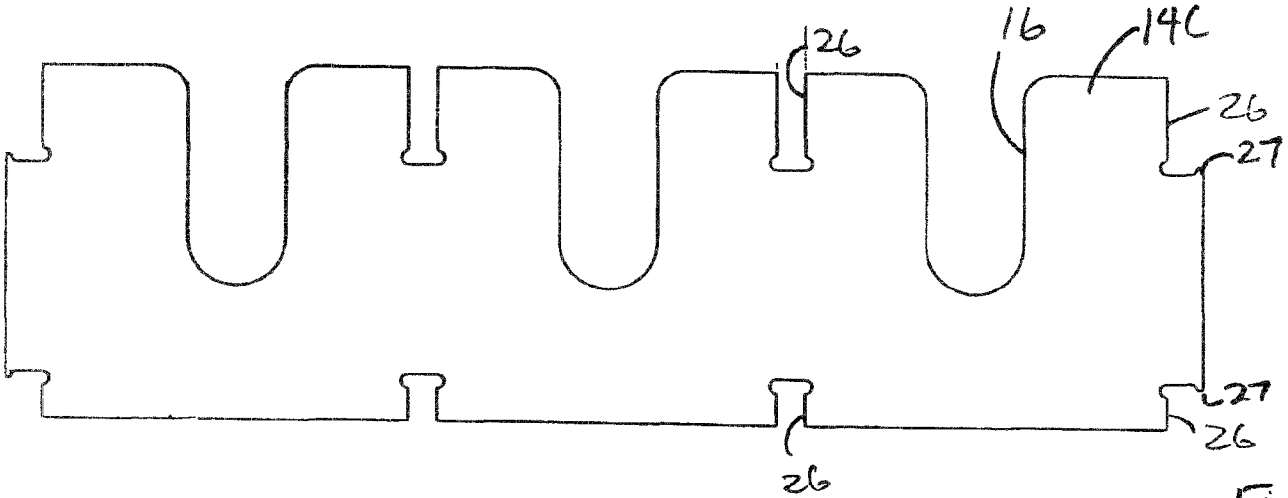

FIGS. 8A-C shows the middle end support with its cut-outs; and FIGS. 9A-C shows the top end-support with its cut outs.

Figures 10A, 10B, 10C:
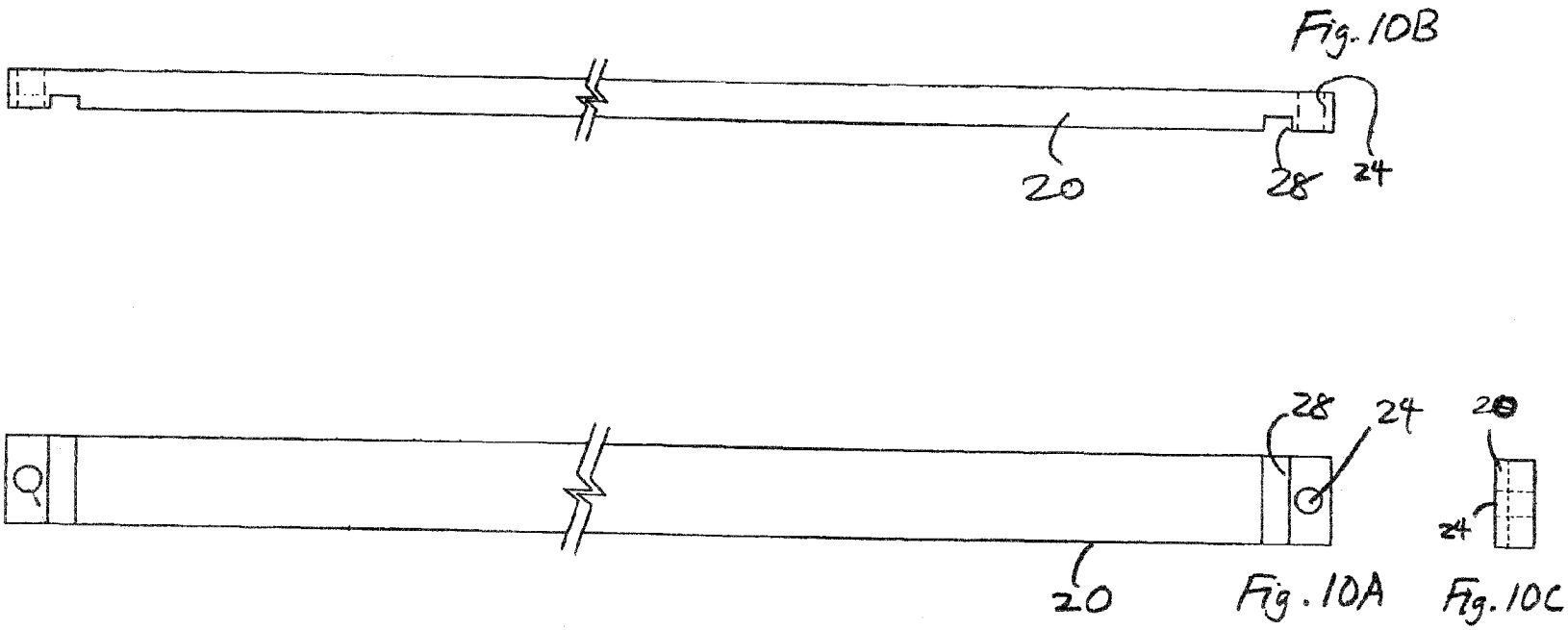
FIGS. 10A, 10B and 10C are, respectively, side elevational, top plan and edge elevational views of a U-slot component of the embodiment of FIG. 1.

FIGS. 10A-C show a rail member with its dados and holes. The material for the rail member may be any dimensional lumber, and may for example be heat treated #2 or better SBF lumber.

Figure 11:
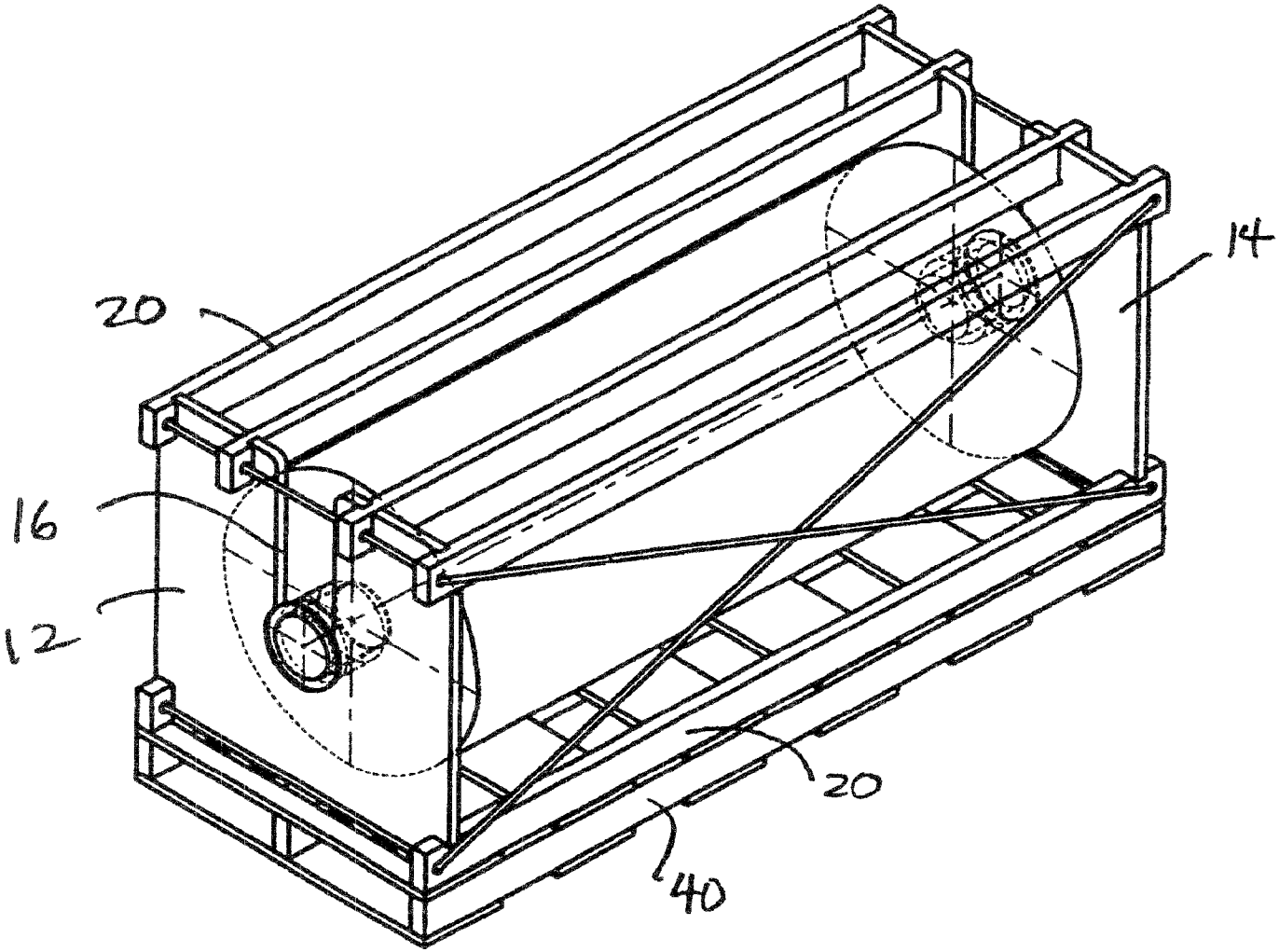
FIG. 11 is perspective view of an alternate embodiment of the invention for a single roll.

FIG. 11 shows an embodiment of the invention for a single roll of goods having a single first end support 12 in one plane and a single second end support 14 in a second plane. Two rail members may be provided to connect the two top corners of the first end support 12 to the second end support 14. The bottom corners of each of the end supports 12, 14 may or may not have rail members.

Although not shown, other embodiments may be made to handle and ship the goods in an n×m (rows×columns) array, where n may be 1 or more and m may be 1 or more. The number and position of the rail members 20 in the end supports may vary depending on the application.

The container according to the invention is flexible in that end supports can be added or removed on an as needed basis, and the rolled goods can be added or removed individually or one layer at a time. By providing this size flexibility, the container need only take up as much space as is needed to store the rolled good or goods of interest.

The rolled goods may be mounted on a core which is longer than the axial dimension of the rolled goods, and the core ends may be received in the V-shaped cut-outs 16 or other provided defined opening or holes in the end supports. Alternatively, the core may be the same axial length as the rolled goods, and short sleeves or core plugs may be inserted partially inside the core ends to protrude axially beyond the rolled goods so that the sleeves or core plugs may be received in the U-shaped cut-outs 16 or other defined opening or holes.

Although two particular embodiments have been illustrated and described, variations and modifications of these embodiments, as well as other embodiments, may occur to those skilled in the art The invention is not limited to these embodiments, and the invention scope is defined by the claims.

What is claimed is:

1. A container for a good having an axial dimension, the container comprising:

upper and lower first end supports having four corners each first end support consisting of a generally flat board with material entirely removed at the corners to define a notch cut-out and an extension ear and being oriented in a first plane, the upper and lower first end supports arranged vertically;

upper and lower second end supports having four corners, the upper and lower second end supports arranged vertically, and each second end support consisting of a generally flat board with material removed at the corners to define a notch cut-out and an extension ear and being oriented in a second plane spaced axially from the first plane;

wherein each corner of each end support has a vertical edge and a horizontal edge, and wherein each notch cut-out in each corner is defined by a vertical boundary inset from the vertical edge of the end support, and further defined by a horizontal boundary inset from the horizontal edge of the end support, and further defined by an enlarged curved cut-out portion further inset from both the vertical edge and horizontal edge than the vertical boundary and horizontal boundary, respectively;

at least four connecting rails having first and second ends, the first ends of at least two rails being removably connected to a first end support at the notch cut-out and the second ends of the at least two rails being removably connected to a second end support at the notch cut-out, each rail being connected to a different corner of the upper first end support and a corresponding corner of the upper second end support, wherein the upper end supports are supported by their respective lower end supports, wherein the extension ear aids in keeping the rail from sliding away from the end support, but permits the rail to be inserted and removed from the sides of the notches by angling the rail relative to the support and notch and wherein each end support has an opening entirely therethrough to provide a support for suspending at least one good with the axial dimension of the good in a horizontal plane.

2. The container according to claim 1, wherein the defined opening is a hole.

3. The container according to claim 1, wherein the opening is a U-shaped cut-out.

4. The container according to claim 1, wherein the first end support and second end support each define a plurality of openings for supporting a corresponding plurality of goods.

5. The container according to claim 1, wherein each of the connecting rails is longer than the spacing between the axial spacing between the first and second planes so that the first and second ends of the connecting rails extend beyond the first and second end supports.

6. The container according to claim 1, wherein the first and second end supports are dimensioned relative to a good to support a plurality of goods in an axially parallel relationship.

7. The container according to claim 1, wherein the first and second end supports each defines notches along the top edges to receive connecting rails.

8. The container according to claim 1, wherein a plurality of first end supports are arranged vertically, and a corresponding plurality of second end supports are arranged vertically, to support at least a corresponding plurality of goods in a vertically stacked relationship.

9. The container according to claim 8, further including reinforcement channel members to connect the end supports vertically.

10. The container according to claim 8, wherein the reinforcement channel members have an H-shaped cross-section.

11. The container according to claim 1, further including a member between each lowest end support and a pallet, said member being one of a U-clip member and a wood member.

12. The container according to claim 1, further comprising goods, wherein the goods comprise at least one roll coiled about an axis.

13. The container according to claim 1, wherein the ends of the rails are removably connected to the end supports by way of dados formed in edges of the end supports.

14. A container for goods having an axial dimension, the container comprising:

a plurality of first end supports each having four corners, said first end supports consisting of a generally flat board and being removably connected in a stacked arrangement and oriented in a first plane;

a plurality of second end supports each having four corners, said second end supports consisting of a generally flat board and being removably connected in a stacked arrangement and oriented in a second plane spaced axially from the first plane;

wherein each of said first end supports and second end supports define a plurality of openings entirely therethrough to provide a support for suspending a corresponding plurality of rolled goods wound on a core with the circumferential surface of the rolled good being free of weight-bearing contact with the first and second end supports;

wherein each corner of each end support has a vertical edge and a horizontal edge, and wherein each notch cut-out in each corner is defined by a vertical boundary inset from the vertical edge of the end support, and further defined by a horizontal boundary inset from the horizontal edge of the end support, and further defined by an enlarged curved cut-out portion further inset from both the vertical edge and horizontal edge than the vertical boundary and horizontal boundary, respectively;

a plurality of connecting rails having first and second ends, the first ends being removably connected to the first end supports and the second ends being removably connected to the second end supports, each rail being connected to a different corner of a first end support and a corresponding corner of a second end support, wherein one first end support is supported by another first end support, wherein each of the first end supports and second end supports has material entirely removed at the corners to define a notch cut-out in each of its corners for receiving the connecting rail, wherein the notch cut-out has an extension ear for restricting slide out of a connecting rail wherein each of the connecting rails is longer than the spacing between the axial spacing between the first and second planes, wherein the extension ear aids in keeping the rail from sliding away from the end support, but permits the rail to be inserted and removed from the sides of the notches by angling the rail relative to the support and notch and wherein at least one good may be suspended between and supported by the first end support and second end support, with the axial dimension of the good in a horizontal plane.

15. The container according to claim 14, wherein the defined openings are holes.

16. The container according to claim 14, wherein the defined openings are U-shaped cut-outs.

17. The container according to claim 14, wherein the ends of the connecting rails define holes for receiving a strapping material to hold the rails in position at the corners of the first and second end supports.

18. The container according to claim 14, wherein the uppermost first and second end supports each define notches along their top edges to receive connecting rails.

19. The container according to claim 14, wherein the lowermost first and second end supports each define notches along their bottom edges to receive connecting rails.

20. The container according to claim 14, further including reinforcement channel members to connect the end supports vertically.

21. The container according to claim 20, wherein the reinforcement channel members have an H-shaped cross-section.

22. The container according to claim 14, further including a member between each lowest end support and a pallet, said member being one of a U-clip member and a wood member.

23. The container according to claim 14, further comprising goods, wherein the goods comprise at least one roll coiled about an axis.

24. The container according to claim 14, wherein the ends of the rails are removably connected to the end supports by way of dados formed in the edges of the end supports.

25. A container for a good having an axial dimension, the container comprising:

a first end support having four corners and consisting of a generally flat board and being oriented in a first plane;

a second end support having four corners and consisting of a generally flat board and being oriented in a second plane spaced axially from the first plane;

wherein the first end support and second end support each define at least one opening entirely therethrough to provide a support for a rolled good wound on a core;

wherein each corner of each end support has a vertical edge and a horizontal edge, and wherein each notch cut-out in each corner is defined by a vertical boundary inset from the vertical edge of the end support, and further defined by a horizontal boundary inset from the horizontal edge of the end support, and further defined by an enlarged curved cut-out portion further inset from both the vertical edge and horizontal edge than the vertical boundary and horizontal boundary, respectively;

at least two connecting rails having first and second ends, the first ends being removably connected to the first end support and the second ends being removably connected to the second end support, each rail being connected to a different corner of the first end support and a corresponding corner of the second end support;

wherein each of the first end support and second end support has a notch cut-out in each of its top corners defined by material removed at the corners and an extension ear for receiving the connecting rails wherein the extension ear aids in keeping the rail from sliding away from the end support, but permits the rail to be inserted and removed from the sides of the notches by angling the rail relative to the support and notch;

wherein each of the connecting rails is longer than the spacing between the axial spacing between the first and second planes;

a strapping material connected to the ends of the connecting rails for holding the first and second end supports in spaced relation; and wherein at least one good may be suspended between and supported by the openings in the first end support and second end support, with the axial dimension of the good in a horizontal plane and with the circumferential surface of the rolled good being free of weight-bearing contact with both the first and second end supports and connecting rails.

* * * * *